United States Patent [19]

Guibord et al.

[11] 4,340,150

[45] Jul. 20, 1982

[54] AUTOMATIC NOTE DISPENSER WITH PURGE CONTROL

[75] Inventors: Ronald D. Guibord, Boylston; Neil W. Harman; Richard E. Hennessy, both of Marlborough, all of Mass.

[73] Assignee: Honeywell Information Systems Inc., Waltham, Mass.

[21] Appl. No.: 255,002

[22] Filed: Apr. 16, 1981

Related U.S. Application Data

[63] Continuation of Ser. No. 103,655, Dec. 14, 1979, abandoned.

[51] Int. Cl.[3] ..... G07F 11/00

[52] U.S. Cl. ..... 221/21; 221/195; 194/1 R; 194/DIG. 26; 133/1 R

[58] Field of Search ..... 221/1, 2, 9, 13, 21, 221/191, 194, 195; 194/1 R, DIG. 26; 133/1 R, 8 R

[56] References Cited

U.S. PATENT DOCUMENTS

| | | | |
|---|---|---|---|
| 3,487,905 | 1/1970 | James | 194/DIG. 26 |
| 3,675,816 | 7/1972 | Bourke et al. | 194/DIG. 26 |
| 3,880,320 | 4/1975 | Morello et al. | 221/9 |
| 4,159,782 | 7/1979 | Swartzendruber | 221/21 X |
| 4,251,009 | 2/1981 | McLaughlin et al. | 194/DIG. 26 |

*Primary Examiner*—Joseph J. Rolla

*Attorney, Agent, or Firm*—Nicholas Prasinos

[57] ABSTRACT

An automatic purge control for a banknote dispensing system including an operator panel having a keyboard for initiating transaction requests, a dispensing chamber adjacent to the panel for receiving banknotes dispensed in response to an operator request, a lockable access door to enable the operator to gain access to the chamber to remove dispensed notes, and a tiltable platform positioned within the chamber for discharging dispensed notes from the chamber under predetermined purge conditions detected by a microprocessor within the system. The microprocessor calls for a purge operation when it has been determined that the operator has either failed to remove dispensed notes or has left notes within the chamber. A purge operation may also be performed as a result of a system failure, such as a power outage or a counting error occurring during a dispense cycle; or when a foreign object is detected in the dispensing chamber as a result of vandalism.

21 Claims, 7 Drawing Figures

AUTOMATIC NOTE DISPENSER WITH PURGE CONTROL

This application is a continuation of application Ser. No. 103,655, filed Dec. 14, 1979, now abandoned.

FIELD OF THE INVENTION

This invention pertains to automatic dispensing systems for banknotes, cash, checks, stamps and the like, and more particularly, to an automatic note dispensing system in which a purge control is provided for recovering dispensed notes which have been allowed to remain in the system after a dispensing operation.

BACKGROUND OF THE INVENTION

Banking systems employing automatic dispensing terminals are being increasingly employed by banks and other financial service organizations as a means for reducing labor expenses and providing extended banking hours and enhanced convenience to customers.

One of the problems that has been experienced in the use of automatic teller terminals with banknote (cash) dispensing devices is that on occasion dispensed notes are inadvertently left in the dispensing chamber either through the carelessness of the customer-operator or through his failure to understand the operating instructions. When this occurs the next customer using the dispenser will receive money to which he is not entitled and the bank will have no means of confirming a subsequent claim made by the first customer, after he realizes that his money was left in the machine.

An additional problem that has been experienced in the use of these automatic dispensing terminals is that on occasion the system will detect an error, such as a double feed or an improper count during the dispensing operation, and when this occurs the system is confronted with a dilemma. The system can release the dispensed notes to the customer, realizing that the amount may be in error and that the customer will be given more or less cash than was requested, or it can lock the customer access mechanism to prevent release of the cash to the customer, in which case the problem can be remedied only by manual intervention of a bank employee. With the former alternative, the customer may either be short changed or receive a windfall of extra cash, whereupon in either case the bank is detrimentally affected. In the latter situation, the immediate customer requesting the dispensing operation, as well as other customers that may be waiting to use the terminal, are inconvenienced and additional time is required on the part of bank personnel to remedy the situation.

OBJECTS AND SUMMARY OF THE INVENTION

Accordingly, it is an object of the present invention to provide an improved cash or note dispensing system. As used herein the word "note" is intended to refer not only to bills or banknotes, but also to other negotiable type documents such as checks, airline tickets, food stamps, and the like.

A further object is to provide an improved note dispensing system having a purge control device which permits the system to recover dispensed cash or notes automatically in certain conditions when abnormal or erroneous operation has been detected.

An additional object is to provide a purge control apparatus for an automatic note dispensing system in which dispensed notes are automatically discharged from the dispensing chamber to prevent a user of the system for obtaining money to which he is not entitled.

Still a further object is to provide a purge control of the type described including devices for detecting when a note or notes has been left in the system following a dispensing operation and for recovering such notes before they can be removed by an unauthorized individual.

Yet a further object is to provide a purge control of the type described including interlock devices to prevent an operator from gaining access to the dispensing chamber during a purge operation.

Still an additional object is to provide an automatic dispensing system of the type described employing a discharge device for purging dispensed notes from a dispensing chamber in the event that notes are left in the dispensing apparatus due to an incomplete dispensing operation.

To achieve the foregoing objects and in accordance with a first aspect of the invention, a note dispensing system is provided including means for requesting a note dispensing operation, a dispensing chamber having an access door by which an operator can gain access to the chamber, means for dispensing at least one note into the chamber in response to a dispensing operation request, security means for locking the access door during a note dispensing operation and for unlocking the door upon completion of the operation to permit the operator to open the door to remove the note, and purge means for discharging the dispensed note from the chamber if the door is not opened within a set period of time following the unlocking of the door by the security means.

In accordance with another aspect of the invention, a note dispensing system is provided including request means for requesting a note dispensing operation, a dispensing chamber, means, means for dispensing at least one note into the chamber in response to a dispensing operation request, operator-actuable access means conditioned in response to completion of the dispensing operation for permitting an operator to gain access to the chamber to remove the note, a tiltable platform included in the chamber for receiving the note after the dispensing operation, and purge means for tilting the platform to discharge the note from the chamber if the operator does not actuate the access means within a set period of time after the latter has been conditioned for operation.

In accordance with still another aspect of the invention, a note dispensing system is provided including request means for requesting a note dispensing operation, a dispensing chamber, means for dispensing at least one note into the chamber in response to a dispensing operation request, operator-actuatable access means for permitting an operator to gain access to the chamber to remove the note, and purge means including a platform provided in the chamber for receiving the note after the dispensing operation, note sensing means for sensing the presence of a note on the platform, and control means responsive to the note sensing means for discharging the dispensed note from the chamber if the note sensing means continues to sense the presence of the note on the platform for a predetermined period of time following actuation of the access means.

In accordance with still a further aspect of the invention, there is provided in an automatic note dispensing system including dispensing means for dispensing a note into a dispensing chamber, and further including purge means for automatically discharging the note from the chamber, and operator-actuatable access means for permitting an operator to gain access to the chamber to remove the note, a method for controlling the dispensing system including the steps of locking the access means to inhibit operator access to the chamber during the dispensing operation, unlocking the access means on completion of the dispensing operation to permit the operator to actuate the access means and remove the note, and operating the purge means to discharge the note from the chamber if the access means is not actuated within a set period of time after it is unlocked.

In accordance with yet another aspect of the invention, there is provided a dispensing system including a dispensing chamber having an access door by which an operator can gain access to the chamber, means for dispensing an item into the chamber, security means for locking the access door during a dispensing operation and for unlocking the door upon completion of the operation to permit the operator to open said door to remove the item, purge means for automatically discharging the item from the chamber, and control means for actuating the security means to lock the access door during the operation of the purge means.

The accompanying drawings which are incorporated in and constitute a part of this specification, illustrate a preferred embodiment of the invention and together with a description serve to explain the principles of the invention.

DETAILED DESCRIPTION OF EMBODIMENT

Figure 1:
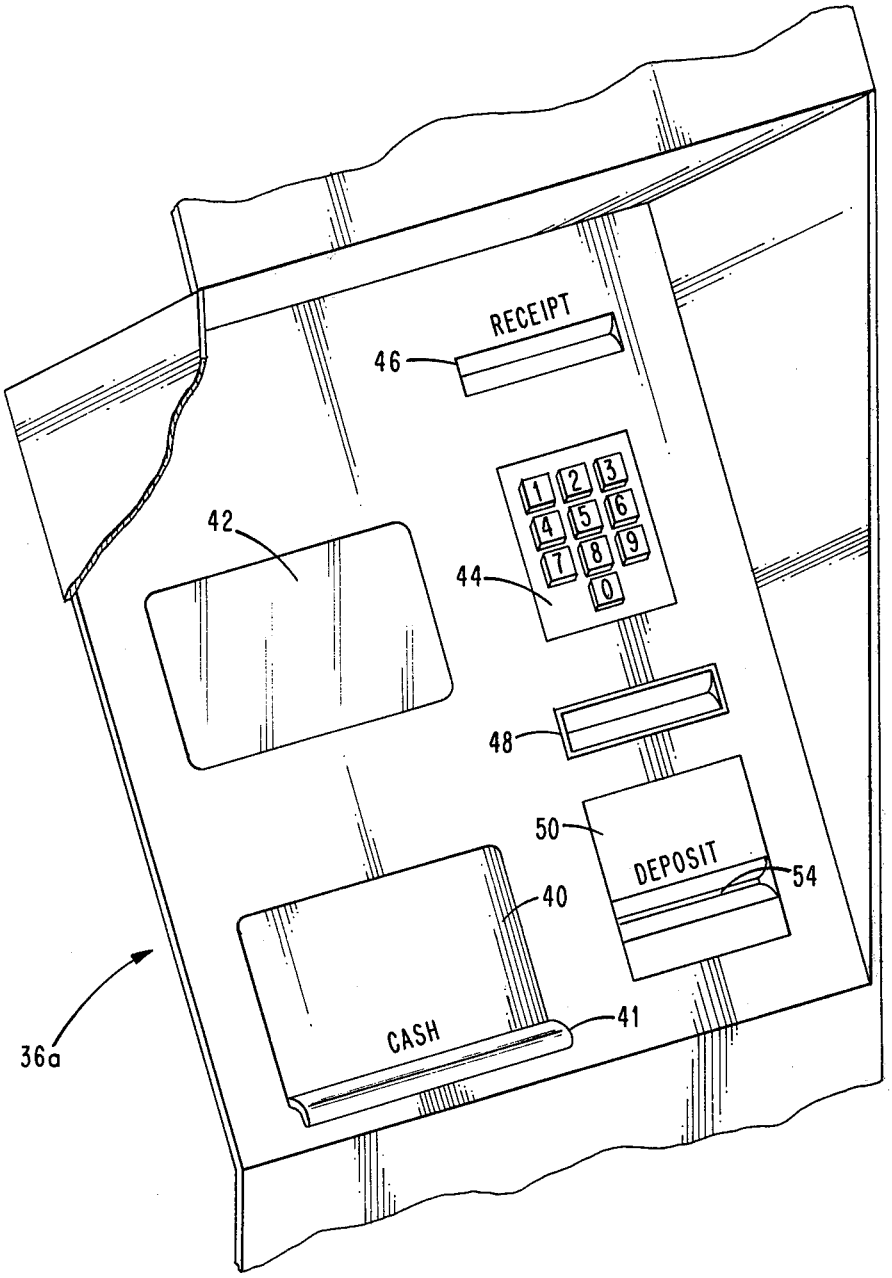
FIG. 1 is a perspective view, partially sectioned, of the customer of operator's panel which permits the operator to make a note dispensing request and to receive dispensed notes.

FIG. 1 shows the operator panel 36*a* which forms the customer or operator interface for the system of the invention. The panel includes a cash or note access door 40 which may be actuated by the operator by raising handle 41 to gain access to the note dispensing chamber to remove any cash or notes therein. An instruction screen 42, e.g., the face of a cathode ray tube (CRT), is controlled by the system to display step-by-step instructions for walking the operator through each transaction. A 10-key keyboard 44 provided on the panel 36*a* enables the operator to enter data which is required to request and complete the transaction. A slot 46 is provided for presenting a transaction receipt to the customer for those transactions which require a receipt. A further slot 48 is provided to enable the operator to insert his personal identification card into the panel, enabling a card reader located behind the panel to read the data on the card and feed it to the system in accordance with known system operation procedures. The operator panel also includes a depository station 50 including a deposit slot for receiving an envelope or envelopes inserted by the operator during deposit transactions.

In general, to operate the system, the operator inserts an identification card, which includes magnetically encoded data uniquely identifying the operator, into slot 48 of the operator's panel. The card reader alerts the system to the upcoming transaction and feeds the data on the card through the system to identify the operator. Thereafter, instructions are displayed on the screen 42 and the operator responds thereto by keying in his personal identification number (PIN) via keyboard 44. The PIN is compared with the data on the identification card to validate the transaction request. Thereafter, the operator utilizes the keyboard 44 to inform the system of the type of transaction desired, the amount involved, etc. When the transaction involves the delivery of cash, the system causes notes to be dispensed into the dispensing chamber located behind access door 40 and, when signalled by the system, the operator opens the door and removes the cash.

Figure 2:
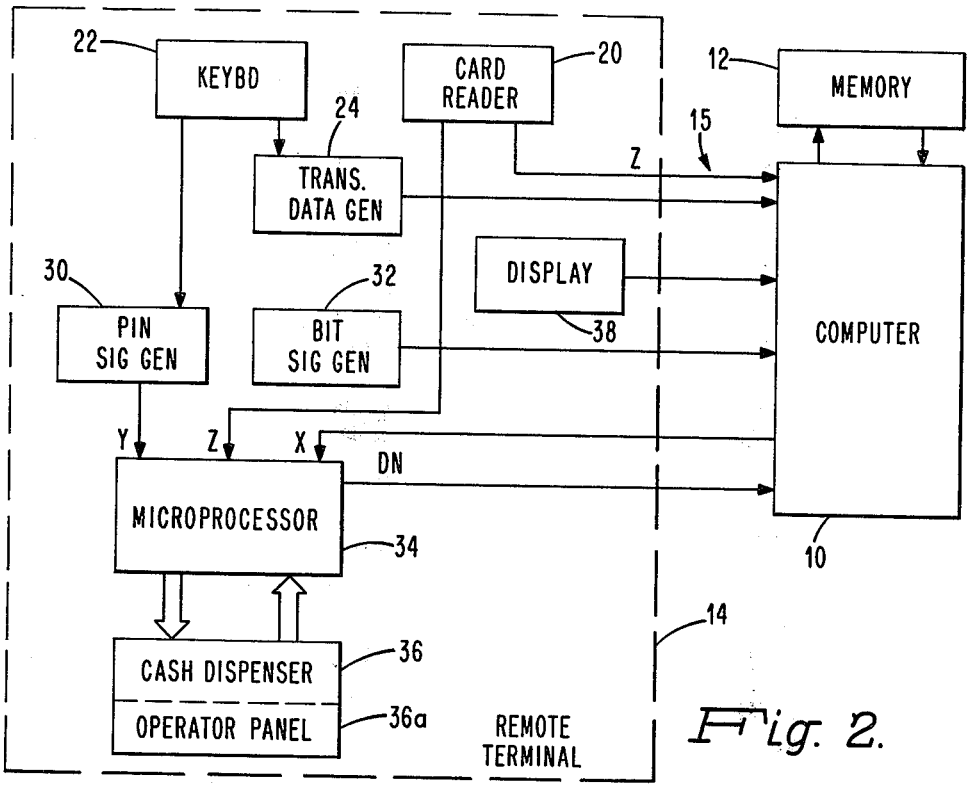
FIG. 2 is a schematic block diagram of a cash dispensing system incorporating the present invention.

A general block diagram of the overall system is shown in FIG. 2. The structure and operation of the system is described in detail in U.S. Pat. No. 4,075,460 issued to Richard A. Gorgens, which is incorporated herein by reference. In general, the system comprises a centralized computer 10 and memory unit 12 which is in communication via data lines 15 with a remote terminal 14 including a cash dispenser 36 and operator panel 36*a*. PIN data keyed into keyboard 22 by the operator is fed to a PIN signal generator 30 to generate a signal representative of a series of numbers entered by the operator, which signal is denoted by reference character Y.

A BIT signal generator 32 is responsive to PIN signal generator 30 to generate a signal representative of the number of bits in the PIN signal generated by signal generator 30. The BIT signal is transferred via one of the lines 15 to the computer 10. A transaction data generator 24 encodes transaction data entered into keyboard 22 and transmits it to the computer 10 via the lines 15. The magnetic card reader 20, which reads the data from the customer identification card inserted into slot 48 (FIG. 1), transmits the card data signal Z to the computer. The computer controls the display device 38 to display operator instructions appropriate to the type of transaction.

A security device, for example, microprocessor 34, receives the Y and Z signals from the signal generator 30 and card reader 20, respectively, and in addition receives an X signal from the computer 10 and, upon appropriate validation of all three signals as described in U.S. Pat. No. 4,075,460, issues a dispense signal to cash dispenser 36. This initiates a dispensing operation for dispensing the requested notes into the dispensing chamber associated with the operator panel 36*a*.

Figure 3:
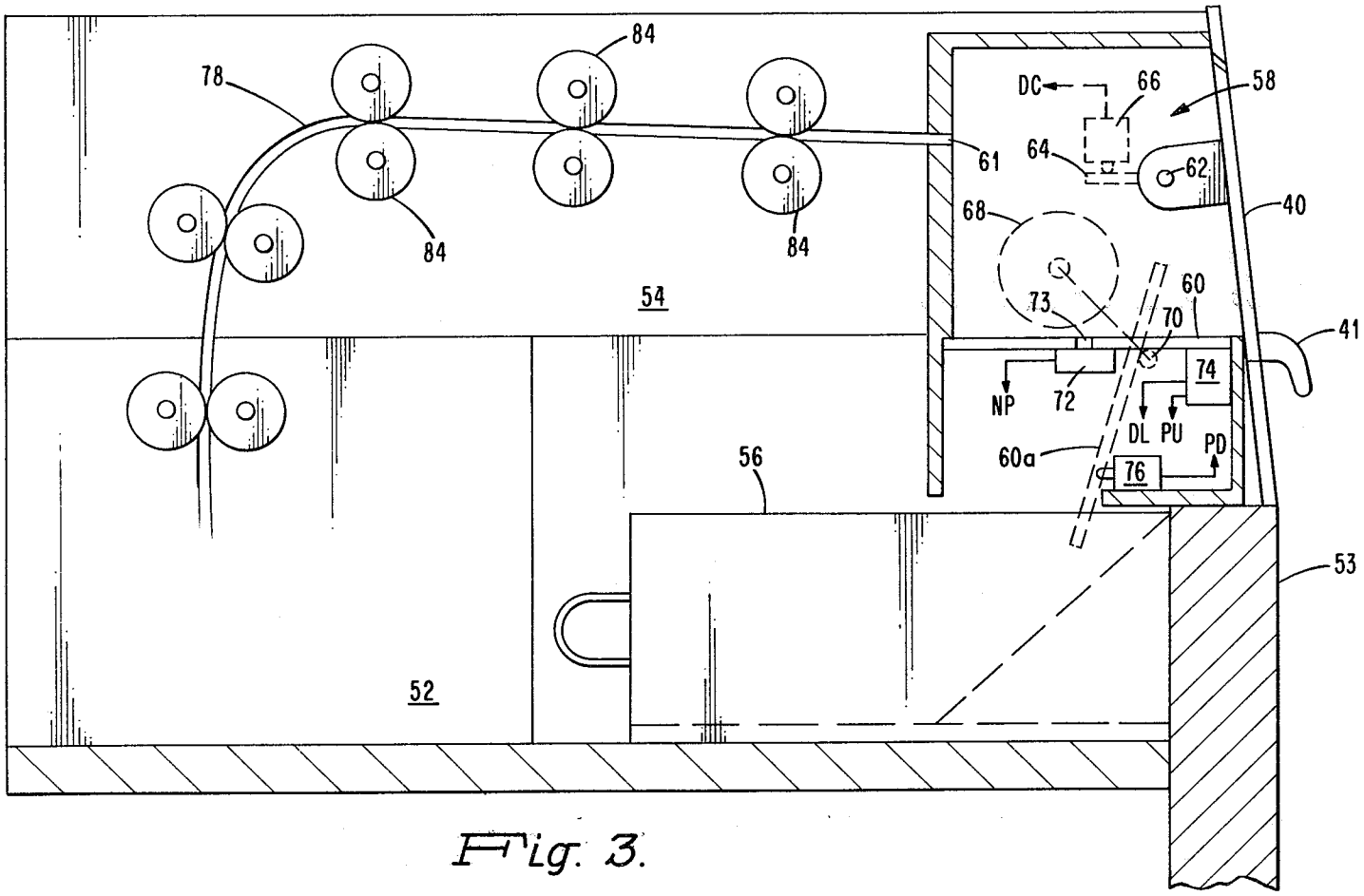
FIG. 3 is a cross-section view taken through the cash dispensing chamber associated with the panel of FIG. 1.

FIG. 3 illustrates the note dispensing system and dispensing chamber utilized in accordance with the invention. The dispensing system comprises a feed module 52, a transporter module 54, a purge bin 56, and a dispensing chamber 58. The feed module comprises conventional elements for storing a supply of notes and means for automatically feeding a particular number of notes on command from microprocessor 34 to the feed chute 78 provided in the transporter module 54. A plurality of feed rolls 84 are positioned along the chute 78 and function during a dispensing operation to feed a note or notes from the module 52 to the dispensing chamber 58. The entire dispensing apparatus is contained within a safe, the front wall of which is shown at 53.

As shown in FIG. 3, dispensing chamber 58 is positioned behind the access door 40 and receives dispensed notes through a slot 61. Dispensed notes fall to the bottom of the chamber and are received on a platform 60 comprising a flat rectangular plate. The access door 40 is pivotally mounted on the chamber sidewalls by means of a pair of stub shafts on either side of the door, one of which as shown as shaft 62 in FIG. 3.

Pivot shaft 62 includes a sensing arm 64 which is affixed to and rotates with the shaft. Arm 64 activates a sensing switch 66, such as a microswitch, whereupon a control signal DC is generated by the switch 66 indicating that the access door 40 is in the fully closed position as shown. Sensing arm 64 and switch 66 are located inside the area of the safe on the opposite side of the dispensing chamber wall so that they cannot be tampered with by a person outside the safe.

The platform 60, which forms the bottom surface of the dispensing chamber, is mounted on a pivot shaft 70 so that it can be pivoted to the opened position shown in dashed lines 60*a* shown in FIG. 3. A control motor 68, also located inside the safe area, is coupled, as by a gear train, to the shaft 70 and is operated by signals from microprocessor 34 in a manner to be described to tilt the platform 60 between the upper (closed) position shown in solid lines and the lower (open) position shown in dashed lines and back again for the purpose of purging the dispensing chamber of notes under predetermined purge conditions to be defined hereinafter.

A note sensing device 72 is provided on the underside of platform 60 and operates through an aperture 73 to sense the presence of a note on the platform. Sensing device 72 may, for example, be a photo-optical device which reflectively senses any object covering aperture 73. To this end the sensor projects a narrow beam of light through aperture 73 upward into the chamber 58. A light receiving aperture positioned immediately adjacent to the projecting aperture will collect radiation reflected from any object such as a bill or a note located immediately above it, i.e., on the platform 60. A photocell provided in sensor 72 senses the radiation and generates the output signal NP, indicating the presence of a note. When no note is present, no radiation is sensed and the signal NP assumes a different, i.e., lower, level. An alternative sensing technique would be to provide a reflective surface on the top wall of the chamber which would reflect a more intense projected beam of light back to the sensing aperture when no note was present in the chamber. Thus, in this latter case, the absence of reflected light, and thus the lower level of NP, would represent the note present condition in a manner opposite to the former arrangement.

A sensing and latching module 74 is affixed to the front wall of the apparatus just below the purge platform 60. Sensing and latching module 74 includes a sensing switch (not shown) similar to switch 66 for providing on output signal PU designating that the platform 60 is in the upper or closed position as shown in solid lines. Module 74 also includes a latching mechanism (also not shown) for locking access door 40 in the closed position and for generating an output signal DL indicating the latched condition. The latching mechanism may be, for example, a solenoid actuated latch bolt or similar device which is controllable for latching and unlatching the access door in response to remote signals from microprocessor 34. The signal DL may be generated by, for example, a microswitch similar to the switch 66 which is positioned to sense when the latching mechanism is in the latched condition. A further sensing switch 76 is provided on a flange below the platform 60 and operates to generate an output signal PD when the platform 60 is in its lower or open position, as illustrated by dashed lines 60*a* in FIG. 3.

A removable collection bin or tray 56 is positioned as shown in FIG. 3 below the dispensing chamber 58 to receive and retain any notes which are discharged from the chamber when the platform 60 is tilted to its lower position, in accordance with the operation of the invention as hereinafter described.

Figure 4:
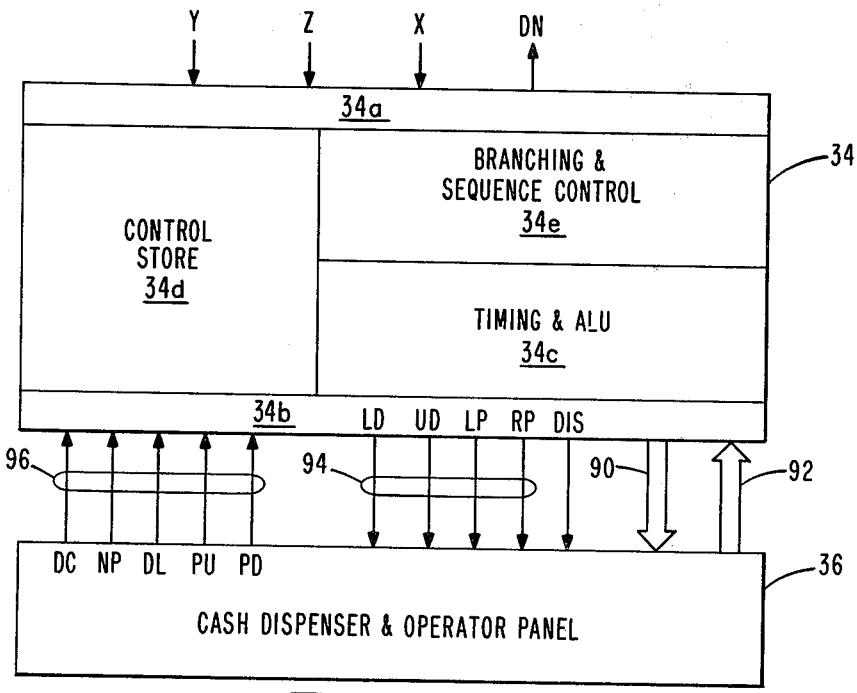
FIG. 4 is a schematic block diagram of the control microprocessor employed in the system to operate the cash dispenser and purge control.

FIG. 4 illustrates the interconnection between microprocessor 34 and the cash dispenser unit 36 insofar as operation of the present invention is concerned. The microprocessor 34 includes interface sections 34*a* and 34*b*, a timing and arithmetic logic unit 34*c*, a control store section 34*d*, and a branching and sequence control section 34*e*. The microprocessor may comprise, for example, a standard 8085 microprocessor chip module as manufactured by Intel Corporation. The microprocessor receives the X, Y, and Z signals from the computer 10, PIN signal generator 30, and card reader 20, respectively. If desired, these signals may be combined in a serial data stream, as in a communications link, rather than being transmitted on separate lines. The microprocessor generates an output signal DN which is transmitted to the computer 10 under certain conditions indicating that the terminal 14 requires manual intervention by a bank employee to service a condition which the system cannot automatically handle.

When microprocessor 34 determines, in response to the X, Y, and Z signals, that a cash dispensing operation is to be initiated, it transmits a DIS signal to the cash dispenser unit 36, triggering the latter to begin the feeding of bank notes from the storage module 52 to the dispensing chamber 58. Various additional signals associated with control of the note dispensing operation are transmitted between the cash dispenser and the microprocessor via lines 90 and 92. The specific control functions associated with these signals are not pertinent to the present invention and are not described herein.

Signals required for controlling the purge function in accordance with the present invention are transmitted from the microprocessor to the cash dispenser via lines 94 and from the cash dispenser to the microprocessor via lines 96. The latter signals include the door closed signal DC, the note present signal NP, the door latched signal DL, the platform up signal PU, and the platform down signal PD generated as previously described. The control signals generated by the microprocessor and transferred via lines 94 include a lock door signal LD, an unlock door signal UD, a lower platform signal LP, and a raise platform signal RP.

The lock door signal LD functions to activate the latching device in latching and sensing module 74 to latch the access door 40. The unlock door signal UD deactivates the latching device to unlatch the access door. Lower platform signal LP energizes motor 68 (FIG. 3) to tilt platform 60 in the counterclockwise direction until the platform down signal PD is generated. The raise platform signal RP energizes drive motor 68 in the opposite direction until the platform up signal PU is generated.

Figure 5:
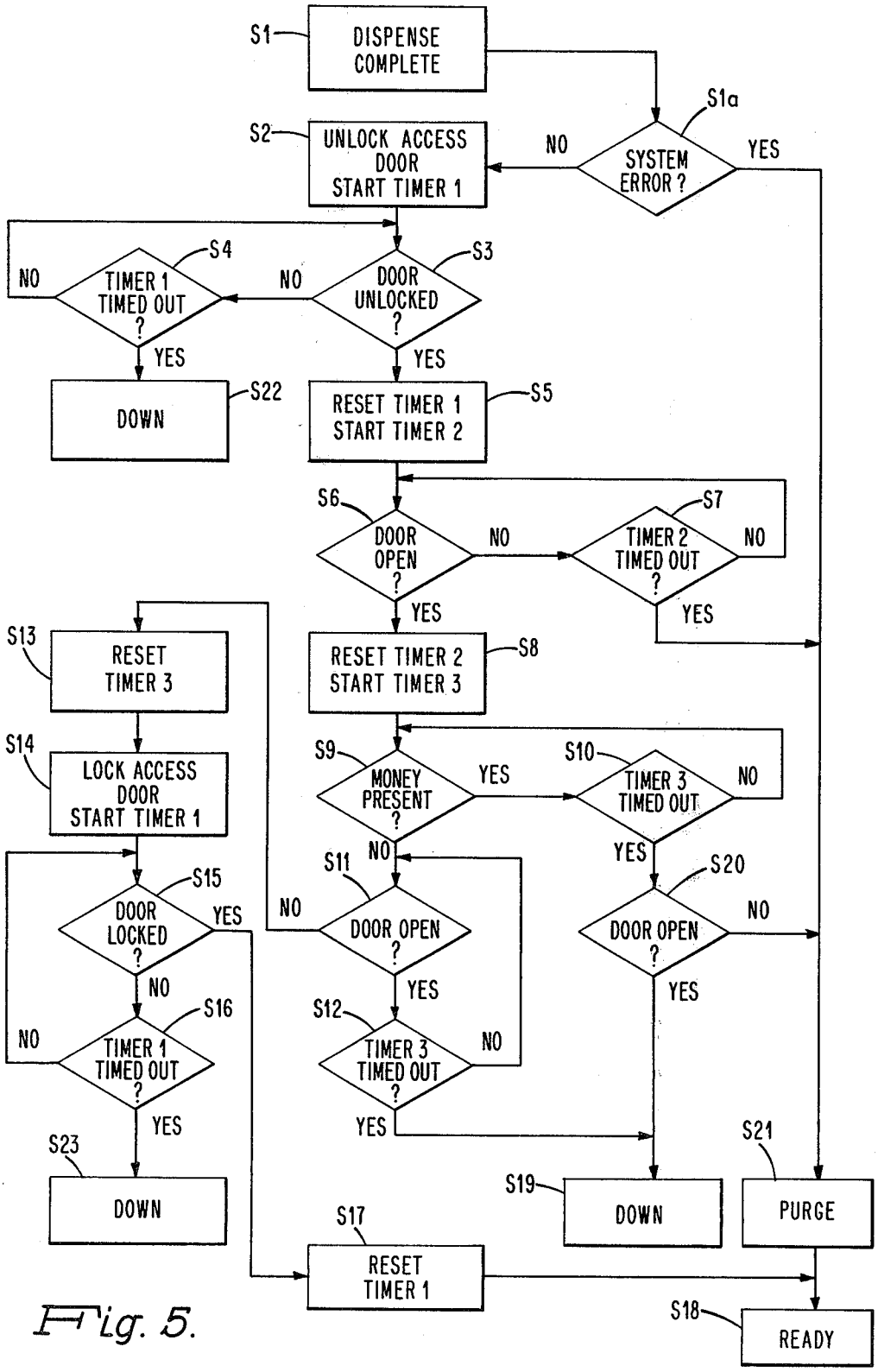
FIG. 5 is a flowchart diagram depicting control firmware stored in the microprocessor for operating the purge control of the present invention.
Figure 6:
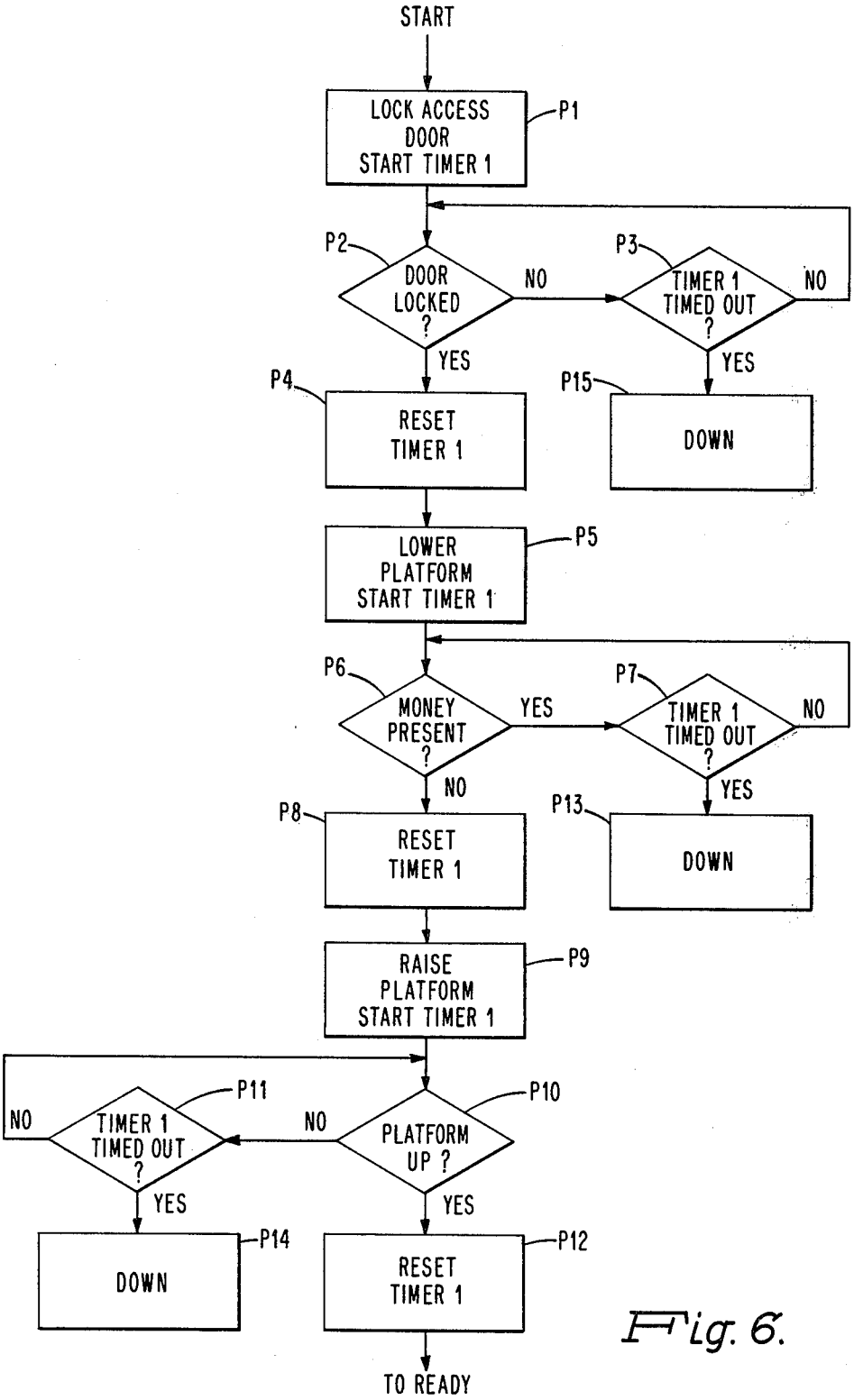
FIG. 6 is a flowchart diagram depicting additional firmware stored in the microprocessor for controlling the purge subroutine which is a part of the firmware depicted in FIG. 5.
Figure 7:
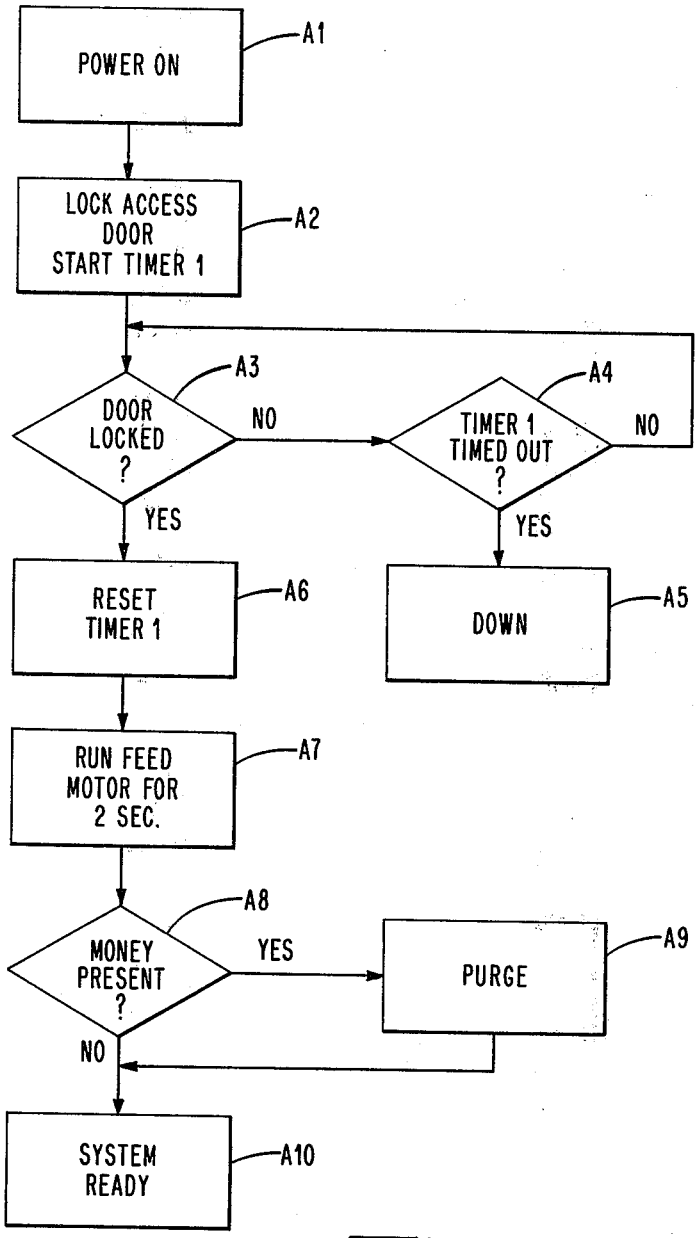
FIG. 7 is a flowchart diagram showing microprocessor firmware used to control the cash dispensing unit during a powerup cycle.

Control of the system for effecting a purge operation is exercised by microinstructions stored in control store section 34*d* of the microprocessor. The microinstructions are represented by the flowchart diagrams of FIGS. 5, 6, and 7. FIG. 5 shows the basic routine for controlling the portion of the note dispensing operation which permits the operator to open the access door and remove the dispensed notes. FIG. 6 represents the microinstructions employed in the purge subroutine wherein dispensed notes are discharged from the dispensing chamber 58 under specified purge conditions. FIG. 7 illustrates the microinstructions which control the dispensing unit during system start-up.

OPERATION

Referring to FIGS. 3, 5, 6, and 7, operation of the automatic dispensing and purge control system of the invention is hereinafter described.

It can be assumed that during the first portion of the dispensing operation when notes are being fed through dispensing chute 78 into the chamber 58, the platform 60 is in its up position, and access door 40 is closed and latched (locked). Thus, the signals DC, DL, and PU will be supplied to the microprocessor from the cash dispenser unit. Since it is also assumed that notes have actually been delivered into the dispensing chamber, the note present signal NP will also be generated at this time.

When the microprocessor determines that the dispensing operation is completed, the microprogram advances from the dispense complete step S1 (FIG. 5) to step S1*a*. Branching step S1*a* tests for the presence of any system error signal which may have been received by the microprocessor during the preceding dispensing operation. Such a signal is stored in a designated flip-flop or register in the microprocessor. The presence of such a signal indicates a system irregularity, such as a detected dispensing error, e.g., a double feed or miscount. If such a signal is present, the program exits steps S1*a* via the Y branch and proceeds directly to the purge step S21.

Assuming that no system error signal is present, the program proceeds to step S2. This causes the microprocessor to issue control signal UD which is supplied to the cash dispenser unit and which deactivates the latching device in sensing and latching module 74, unlatching and thus unlocking the access door 40. Program step S1 also starts a timer 1, which is internally set up within microprocessor 34 and which may comprise, for example, a counter register in the ALU. The timing interval established by timer 1 is selected to reflect the normal time required for the various mechanical operations within the purge system to take place, i.e., the door locking and unlocking and the purge platform raising and lowering operations.

The program thereafter advances to step S3, Door Unlocked!, in which the signal DL is tested to determine whether the unlocking operation has occurred. Initially, DL will indicate the continued presence of the latched condition, so the program branches to step S4 where the state of timer 1 is tested. If the timer has not timed out, the program loops back to step S3. The program continues to traverse the S3-S4 loop until either DL indicates that the door is unlocked or timer 1 times out. If the latter occurs first, step S22 is entered, signalling that an unresolvable problem has been encountered and that the dispensing apparatus should be shut down. This causes the microprocessor to issue the signal DN to the computer 10, whereupon the latter provides an indication that the terminal 14 requires operator attention and all further dispensing commands are inhibited.

However, if in step S3 the signal DL indicates that the access door 40 is unlatched normally, the program takes the Y exit from step S3 and advances to step S5 whereupon timer 1 is reset and a timer 2 is started. The interval set by timer 2 establishes a time window during which the operator who has requested the note dispensing operation must open access door 40.

After the start of timer 2, the program advances to step S6 and thereafter branches to step S7, whereupon it loops back to S6. The timing loop including steps S6 and S7 continues to be traversed until either the access door is opened or timer 2 times out. In the case where the access door is opened before the timer times out, the program takes the Y exit from branching step S6 and advances to step S8, whereupon timer 2 is reset and a timer 3 is started. The interval established by timer 3 defines the length of time which an operator would normally take to remove the notes from the dispensing chamber, once the access door is opened.

The program advances immediately from step S8 to S9, which is a branching step in which the NP control signal from the cash dispenser unit is tested. The program branches through S9 to step S10, loops back to step S9 and continues to traverse the S9-S10 loop until either the signal NP indicates that no note is present in the dispensing chamber or the timer 3 times out. If the notes are removed from platform 60 before timer 3 times out, the program advances through the N exit from branch S9 and enters branching step S11, whereupon the control signal DC is tested to determine whether access door 40 is closed.

The S11-S12 loop is traversed until either the signal DC indicates that the access door has been closed or timer 3 times out. If the access door is closed before timer 3 times out, the program takes the N exit from step S11 and advances to step S13 in which the timer 3 is reset. Thereafter, step S14 is executed to lock access door 40 and restart timer 1. This causes the microprocessor to issue the LD control signal to the cash dispenser unit to energize the latching device in module 74 to engage the door latch and lock the door 40. The program next enters step S15 whereupon the control signals DC and DL are tested to determine if the door is actually locked. These signals must both be present to indicate that the door is locked. The program traverses the S15-S16 loop until either the locking state is established or until timer 1 times out. If the door locks normally, the program exits step S15 through the Y branch and enters step S17, resetting timer 1. Thereafter the program proceeds to step S18, signalling the microprocessor that the dispensed notes have been removed in the normal fashion, that the access door has been locked, and that the system is in condition to perform another dispensing operation.

If in step S15 the signal DC continues to indicate that the door is not closed or the signal DL continues to indicate that the latch is not engaged prior to the time timer 1 times out, the program takes the Y exit from step S16 and executes Down step S23, whereupon the microprocessor issues the DN signal to computer 10, inhibiting further dispensing operations until the locking failure situation is resolved through operator intervention.

If, during the time that the program was traversing the S6-S7 timing loop, timer 2 times out before the control signal DC indicates that the access door is open, the program takes the Y exit from step S7 and executes the purge subroutine of step S21 to discharge any notes that may be present in the dispensing chamber into the purge bin 56. Likewise, if during the time that the program is traversing the S9-S10 timing loop, timer 3 times out before the NP signal indicates that the notes have been removed from the platform 60, the program takes the Y branch out of step S10 and enters the purge routine S21 through branching step S20. The purge is executed only if the access door is closed as determined in step S20 by testing the signal DC.

If the door is not closed, the program branches to Down step S19 and the dispensing system is shut down to await operator intervention. Down step S19 is also executed in the event that the program exits from timing loop S11-S12 via branch Y of step S12. This occurs if the access door is not closed within the period of timer 3.

The purge subroutine S21 is depicted in the flowchart diagram of FIG. 6. The first step in the subroutine, P1, functions to lock access door 40 and start timer 1. The steps P1, P2, P3, and P15 operate identically to the previously described locking steps S14, S15, S16, and S23 to either confirm the locking of the access door or to cause the issuance of a DN signal from the microprocessor to inhibit further dispensing operations until the unlocked door condition is resolved by operator intervention.

After the access door is locked, the purge program advances to step P4 to reset timer 1 and thence to step P5, whereupon the microprocessor restarts timer 1 and issues the control signal LP to activate platform control motor 68. This causes purge platform 60 to be driven counterclockwise to dump any notes thereon into the purge bin 56. This dump operation is monitored by the timing loop comprising steps P6–P7 such that if a note is still detected on the platform when timer 1 times out, the system executes step P13 and shuts down. If the purge is successful, the timing loop is exited through branch N of step P6 and step P8 is executed to reset timer 1.

Thereafter,the program advances to step P9, whereupon timer 1 is restarted and the control signal RP is issued by the microprocessor. This reverses motor 68 and drives the purge platform 60 is a clockwise direction until the signal PU is produced by the sensing module 74. If this does not occur before timer 1 times out, timing loop P10–P11 is exited via branch Y of step P11 and the system shuts down via step P14, whereupon the DN output is produced by microprocessor 34 inhibiting further operation of the dispensing system until operator intervention resolves the situation.

If platform 60 closes normally, the program takes exit Y from step P10 and executes step P12 which resets timer 1. Thereafter, the program proceeds to READY step S18 of the main program, thus signalling the completion of the purge operation and indicating that the system is in condition to handle further dispensing operations.

Purge control is also provided in the system of the present invention during the initial power-up cycle following a system shut down. Since the system shut down may have been caused by a power outage or other type of failure condition, there is a possibility that one or more notes may have been left in the dispensing apparatus in a position which will cause them to be fed into the dispensing chamber during the first dispensing operation following the power-up cycle. As shown in FIG. 7, a microprogram routine included in microprocessor 34 is exercised during the power on cycle to purge any notes that may have been left in the system.

After receiving the power on indication from host computer 10 in step A1, the program proceeds to step A2 where access door 40 is locked. Following that, a timing loop comprising steps A3 and A4 is executed to assure that the door is locked properly. As described previously in connection with FIGS. 5 and 6, branching step A3 tests for the simultaneous presence of the door close signal DC and the door latch signal DL from the cash dispenser unit.

After the access door is locked and timer 1 is reset (step A6), the program proceeds to step A7 where the feed motor associated with the note feeding apparatus in module 54 is turned on for approximately two seconds to clear any notes remaining in the feed into the dispensing chamber 58. Thereafter, branching step A8 is entered and tests for the note present signal NP from the cash dispenser. If NP indicates the presence of a note in the chamber, the program exits step A8 via the Y branch and executes purge step A9. The latter may be identical to step S21 of FIG. 5, which has been described in detail in connection with FIG. 6.

Upon completion of the purge routine, the program advances to system ready step A10 and signals the system that the dispensing system is ready for operation. If a note was not detected in step A8, the program exits via the N branch thereof and proceeds directly to step A10 to generate the system ready indication.

Thus, reviewing the above operations, it is seen that the system of the invention provides a purge control for discharging notes which have been dispensed into an operator accessible dispensing chamber if a feeding irregularity, system error, power outage or the like occurs during a dispensing operation or if the access door to the chamber is not operated within a set period of time following the dispensing operation. Furthermore, if the access door is opened but a dispensed note or notes or other object is left in the chamber after a predetermined period of time following the opening of the door, the purge control system also operates to discharge the remaining notes or objects from the chamber before further operation of the dispensing system is permitted.

The purge control thus prevents a situation in which notes inadvertently or erroneously left in the dispensing chamber become accessible to an unauthorized operator. It further will purge any foreign objects which may be left intentionally or otherwise in the chamber by an operator.

Furthermore, the microprocessor is able, by keeping a record of the occurrences of purge operations during specified transactions, to provide confirming evidence which may be used to either support or refute a customer claim that he did not receive the full amount of cash requested. If a customer makes such a claim, and the record of the transaction indicates that a purge operation was performed, then evidence tending to confirm the customer's claim is provided. However, if the record of the transaction indicates that no purge operation was performed, the evidence indicates that the customer's claim is probably false.

Thus, in summary, it is seen that in accordance with the invention described herein, a note dispensing system is provided having means for requesting a note dispensing operation and further including a dispensing chamber having an access door by which the operator can gain access to the chamber. As illustrated in the exemplary embodiment hereinabove described, requesting means includes the operator panel 36*a* having the keyboard 22 for permitting an operator to request a note dispensing operation. The dispensing chamber and access door are represented in the exemplary embodiment by, respectively, the chamber 58 and door 40.

Further in accordance with the invention the system incorporates means for dispensing at least one note into the chamber in response to a dispensing operation request and security means for locking the access door during a note dispensing operation and for unlocking the door upon completion of the operation to permit the operator to open the door to remove the note. As illustrated in the exemplary embodiment hereinabove described, the means for dispensing at least one note is represented by, for example, the cash dispenser modules 52 and 54, the computer 10, and the microprocessor 34, including the basic cash dispensing control microprogram instructions stored therein. The security means for locking and unlocking the access door is represented for example by the door sensing switches and the portions of the control microprogram represented by the steps S1–S4 and S14–S16 shown in FIG. 5.

Still further, the described invention includes purge means for discharging the dispensed note from the dispensing chamber if the access door is not opened within a set period of time following the unlocking of the door by the security means. As illustrated in the exemplary embodiment described, the purge means is represented by the platform 60 and tilt controls therefor including motor 68, shaft 70 and the associated sensing devices 74 and 76, as well as the portions of the control microprogram represented by steps S5 through S7 and S21 shown in FIG. 5.

Further in accordance with the invention, as hereinabove described, operator-actuatable access means are provided for permitting an operator to gain access to the dispensing chamber to remove dispensing notes. As illustrated in the above-described exemplary embodiment, such operator-actuatable access means is represented by, for example, the access door 40 which requires operator actuation in the form of an opening movement. Furthermore, the purge means is provided with a platform included in the dispensing chamber for receiving a note after a dispensing operation, note sensing means for sensing the presence of a note on the platform, and control means responsive to the note sensing means for discharging the dispensed note from the chamber if the note sensing means continues to sense the presence of the note on the platform for a predetermined period of time following actuation of the access means.

As illustrated in the above-described exemplary embodiment, the platform is represented by platform 60 and the note sensing means is represented by the photo-optical sensing unit 72 and aperture 73. The control means responsive to the note sensing means includes the tilting control elements associated with platform 60 as well as the portions of the control microprogram represented by steps S8, S9, S10, and S20 together with the purge subroutine S21.

It will be apparent to those skilled in the art that various modifications and variations could be made to the embodiment of the invention as hereinabove described without departing from the spirit and scope of the invention.

What is claimed is:

1. A note dispensing system comprising, in combination:

means for requesting a note dispensing operation;

a dispensing chamber having an access door by which an operator can gain access to said chamber;

means for dispensing at least one note into said chamber in response to a dispensing operation request;

security means for locking said access door during a note dispensing operation and for unlocking said door upon completion of said operation to permit said operator to open said door to remove said note; and purge means for discharging said dispensed note from said chamber if said door is not opened within a set period of time following the unlocking of said door by said security means, said dispensing chamber comprising fixed top, rear and side walls, one of said fixed walls being formed with a narrow slot for receiving notes from said means for dispensing, said means for dispensing being blocked from an opening covered by said access door by said fixed walls, said dispensing chamber further comprising a bottom wall tiltable about a shaft, said purge means comprising means for tilting said bottom wall about said shaft for purging only when said access door is closed whereby said bottom wall coacts with said top, rear and side walls to prevent access to said means for dispensing through the opening covered by said access door.

2. The system set forth in claim 1 wherein said means for requesting comprises an operator panel having means for enabling said operator to generate said dispensing operation request and wherein said dispensing chamber is located proximate to said panel.

3. The system set forth in claim 1 in which said security means further comprises means operable, if said door is opened within said set period of time, for relocking said door after said note has been removed from said chamber.

4. The system set forth in claim 1 wherein said fixed rear wall is formed with a narrow slot for receiving a note to be dispensed.

5. The system set forth in claim 1 and further comprising, a platform pivot shaft pivotally supporting said tiltable bottom platform and located outside said dispensing chamber, a control motor located outside said dispensing chamber, means for mechanically coupling said control motor to said platform pivot shaft for selectively rotating said pivot shaft when said control motor is energized to move said tiltable botom platform between a closed normally substantially horizontal position for supporting notes to be dispensed and an open nearly vertical position for purging any notes not removed from said dispensing chamber by gravity, and a purge bin below said tiltable bottom platform for receiving purged notes when said tiltable bottom platform is in the open position.

6. The system set forth in claim 1 in which said purge means comprises sensing means for providing a signal representative of the presence of a note in said chamber, said sensing means being located in said system adjacent said dispersing chamber with said top, side and bottom walls preventing access to said sensing means through said access opening when said door is open.

7. The system set forth in claim 1 in which said purge means comprises:

a tiltable plate comprising said bottom wall positioned to receive said note when it is dispensed into said chamber; and means for tilting said plate to allow gravity to discharge said note from said chamber if said door is not opened within said set period of time.

8. The system set forth in claim 3 or claim 7 further comprising a purge bin for collecting notes discharged from said chamber by said purge means.

9. The system set forth in claim 1 wherein said tiltable bottom platform is formed with a small opening that is covered and uncovered upon the presence and absence respectively of a note in said dispensing chamber, and sensing means adjacent to said opening outside said dispensing chamber for providing a signal representative of the presence and absence of a note in said chamber.

10. The system set forth in claim 9 wherein said means for sensing comprises photo-optical means for reflectively sensing any object covering said opening.

11. The system set forth in claim 1 wherein said access door is pivotally mounted on pivot shafts supported in said fixed side walls at least one of which passes through one of said side walls, a sensing arm outside said dispensing chamber secured to and rotating with said at least one pivot shaft, and switching means outside said dispensing chamber actuated by said sensing arm for providing a door closed signal when said access door is closed.

12. The system set forth in claim 11 and further comprising, a platform pivot shaft pivotally supporting said tiltable bottom platform and located outside said dispensing chamber, a control motor located outside said dispensing chamber, means for mechanically coupling said control motor to said platform pivot shaft for selectively rotating said pivot shaft when said control motor is energized to move said tiltable botom platform between a closed normally substantially horizontal position for supporting notes to be dispensed and an open nearly vertical position for purging any notes not removed from said dispensing chamber by gravity, and a purge bin below said tiltable bottom platform for receiving purged notes when said tiltable bottom platform is in the open position.

13. A method of controlling an automatic note dispensing system including dispensing means for dispensing a note into a dispensing chamber at the request of an operator, purge means for automatically discharging said note from said chamber, and operator-actuatable access means for permitting an operator to gain access to said chamber to remove said note, comprising the steps of:

locking said access means to inhibit operator access to said chamber during said dispensing operation;

unlocking said access means on completion of said dispensing operation to permit said operator to actuate said access means and remove said note; and operating said purge means to discharge said note from said chamber if said access means is not actuated within a set period of time after it is unlocked, upon failure of said system, and upon occurrence of interruption of power to said system.

14. The method set forth in claim 13 wherein said system includes a microprocessor and further including the steps of providing to said microprocessor a DC signal when said access door is closed, a DL signal when said access door is locked and a PU signal when said tiltable bottom platform is upright in a generally horizontal position for supporting notes to be dispensed, sensing completion of the dispensing operation, then testing for the presence of any system error signal which may have been received by said microprocessor during the preceding dispensing operation, then operating said purge means to discharge said note from said dispensing chamber upon sensing a system error signal, providing a control signal UD for unlocking the access door in the absence of a system error signal to unlock said access door, then activating a timer for establishing a timing interval for establishing a predetermined mechanical operations timing interval, alternately sensing a signal source representative of whether said access door is unlocked and a signal provided by said timer indicative of whether said mechanical operations timing interval has expired until sensing that either said access door is unlocked or said mechanical operations timing interval has expired, disabling said dispensing system if said mechanical operations timing interval expires before sensing said access door is unlocked, resetting said timer upon sensing said access door is unlocked before said mechanical operations timing interval has expired and starting a second timer for establishing an operator time interval during which an operator who has requested the note dispensing operation must open said access door, alternately sensing whether said access door is opened or said operator time interval has expired until either said access door is open or said operator time interval expires, initiating said purge operation if said operator time interval expires before said door is opened, resetting said second timer if said access door is opened before said operator time interval expires and starting a third timer for defining a note removal time interval corresponding to the length of time an operator would normally take to remove notes from said dispensing chamber once said access door is opened, alternately sensing an NP control signal representative of whether a note is present in said dispensing chamber and the state of said third timer until said NP signal indicates that no note is present in said dispensing chamber or said note removal time interval has expired, alternately sensing a DC control signal representative of said access door being closed and said third timer until either said DC signal indicates said access door has been closed or said note removal time interval expires, initiating said purge operation if said note removal interval expires, resetting said third timer if said access door is closed before said note removal time interval expires, then locking said access door and restarting said first timer, sensing said DC and DL control signals alternately with said first timer until said door is locked or said mechanical operations time interval expires, resetting said first timer if said access door is locked before said mechanical control time interval expires, then signaling said microprocessor that the dispensed notes have been removed in normal fashion, said access door has been locked and said system is in condition to perform another dispensing operation.

15. The method set forth in claim 14 wherein the initiation of said purge operation includes the following steps, locking said access door and starting said first timer, resetting said first timer when said access door is locked, restarting said first timer and providing an LP control signal that tilts said tiltable bottom platform to dump any notes thereon into a purge bin below, alternately sensing said NP signal and the state of said first timer to disable said dispensing system if a note is present on said tiltable bottom platform when said mechanical operations interval expires, resetting said first timer if said tiltable bottom platform is free of notes before said mechanical operations timing interval expires, then restarting said first timer and providing an RP control signal for restoring said tiltable bottom platform to its normally generally horizontal position to restore said tiltable bottom platform to its normally generally horizontal position until said PU signal is provided, disabling said note dispensing system if said tiltable bottom platform does not return to its normaly generally horizontal position before said mechanical operations timing interval expires, providing a signal when said tiltable bottom platform returns to its normal generally horizontal position to signal completion of said purge operation and ready said note dispensing system for handling further note dispensing operations.

16. The method according to claim 15 and further including initiating said purge operation in response to the initial power-up cycle following a shut-down of said note dispensing system.

17. A method of controlling an automatic note dispensing system including dispensing means for dispensing a note into a dispensing chamber having fixed top, rear and side walls one of which is formed with a narrow slot for receiving a note to be dispensed, an access door and a tiltable bottom platform formed with a small opening, at the request of an operator, purge means including said tiltable bottom platform for automatically discharging said note from said chamber, and operator-actuatable access means including said access door for permitting an operator to gain access to said chamber to remove said note, comprising the steps of:

sensing whether said access means is in an actuated state;

sensing through said small opening in said tiltable bottom platform whether a note is present or absent in said chamber; and operating said purge means by tilting said tiltable bottom platform to discharge said note from said chamber after a note dispensing if said second-mentioned sensing step continues to indicate the presence of a note in said chamber for a predetermined period of time after said first-mentioned sensing step indicates the actuation of said access means.

18. The method set forth in claim 17 comprising the further step of:

inhibiting said purge operation and locking said access means to prevent said operator from gaining further access to said chamber if said second-mentioned sensing step indicates the absence of a note in said chamber after said first-mentioned sensing step indicates the actuation of said access means.

19. The method set forth in claim 18 comprises the further step of:

inhibiting said locking operation and disabling further operation of said dispensing means if said first-mentioned sensing step indicates that said access means remains in the actuated state for more than said predetermined period of time.

20. A method of purging a dispensed note from a dispensing chamber in an automatic note dispensing system including means for feeding a note into a dispensing chamber in response to a note dispensing request and operator-actuatable access means for permitting an operator to gain access to said chamber to remove said note, comprising the steps of:

testing for the presence of an error signal in said note dispensing system during a preceding dispensing cycle in response to a note dispensing request, upon sensing the presence of a system error signal disabling said access means to prevent actuation thereof, whereby said operator is denied access to said chamber;

discharging said note from said chamber after said access means is disabled, sensing for the presence of a note in said chamber; and providing a purge complete indication to condition said system for further dispensing operations if said sensing step does not indicate the presence of a note in said chamber.

21. The method set forth in claim 20 comprising the further steps of:

timing the period during which the presence of said note is sensed in said chamber; and inhibiting said purge complete indication and disabling further note feeding operations if the presence of a note is sensed in said chamber for a duration exceeding a predetermined period of time.

* * * * *